US008957595B2

(12) United States Patent
Johnston et al.

(10) Patent No.: US 8,957,595 B2
(45) Date of Patent: Feb. 17, 2015

(54) METHODS AND APPARATUS FOR ENCODING INFORMATION ON AN A.C. LINE VOLTAGE

(75) Inventors: Scott D. Johnston, Boston, MA (US); Michael Keenan Blackwell, Milton, MA (US)

(73) Assignee: Koninklijke Philips N.V., Eindhoven (NL)

( * ) Notice: Subject to any disclaimer, the term of this patent is extended or adjusted under 35 U.S.C. 154(b) by 805 days.

(21) Appl. No.: 12/989,091

(22) PCT Filed: Apr. 21, 2009

(86) PCT No.: PCT/IB2009/051633

§ 371 (c)(1), (2), (4) Date: Oct. 22, 2010

(87) PCT Pub. No.: WO2009/133489

PCT Pub. Date: Nov. 5, 2009

(65) Prior Publication Data

US 2011/0043124 A1 Feb. 24, 2011

Related U.S. Application Data

(60) Provisional application No. 61/048,986, filed on Apr. 30, 2008.

(51) Int. Cl.
*G05F 1/00* (2006.01)
*H05B 37/02* (2006.01)

(52) U.S. Cl.
CPC ..... *H05B 37/0263* (2013.01)
USPC ..... 315/291; 315/308; 315/307; 315/314; 315/265; 315/246

(58) Field of Classification Search
CPC ..... H05B 33/0815; H05B 33/0827
USPC ..... 315/291, 308, 307, 314, 265, 253, 339, 315/360, 362, DIG. 4
See application file for complete search history.

(56) References Cited

U.S. PATENT DOCUMENTS

| | | | | |
|---|---|---|---|---|
| 6,016,038 | A | 1/2000 | Mueller et al. | |
| 6,069,457 | A * | 5/2000 | Bogdan | 315/291 |
| 6,211,626 | B1 | 4/2001 | Lys et al. | |

(Continued)

FOREIGN PATENT DOCUMENTS

| | | | |
|---|---|---|---|
| EP | 1233656 | A1 * | 8/2002 |
| WO | 9938363 | A1 | 7/1999 |
| WO | 2005115058 | A1 | 12/2005 |

*Primary Examiner* — Douglas W Owens
*Assistant Examiner* — Borna Alaeddini
(74) *Attorney, Agent, or Firm* — Yuliya Mathis

(57) ABSTRACT

An AC line voltage may be encoded with control information, such as dimming information derived from an output signal of a conventional dimmer, so as to provide an encoded AC power signal. One or more lighting units, including LED-based lighting units, may be both provided with operating power and controlled (e.g., dimmed) based on the encoded power signal. In one implementation, information may be encoded on the AC line voltage by inverting some half cycles of the AC line voltage to generate an encoded AC power signal, with the ratio of positive half-cycles to negative half-cycles representing the encoded information. In other aspects, the encoded information may relate to one or more parameters of the light generated by the LED-based lighting unit(s) (e.g., intensity, color, color temperature, etc.).

25 Claims, 7 Drawing Sheets

(56) References Cited

U.S. PATENT DOCUMENTS 6,225,759 B1 * 5/2001 Bogdan et al. ..... 315/291
6,583,573 B2 * 6/2003 Bierman ..... 315/149
6,982,887 B2 * 1/2006 Batarseh et al. ..... 363/89
7,038,399 B2 5/2006 Lys et al.
2005/0104543 A1 * 5/2005 Kazanov et al. ..... 315/294
2005/0248440 A1 11/2005 Stevens

* cited by examiner

METHODS AND APPARATUS FOR ENCODING INFORMATION ON AN A.C. LINE VOLTAGE

TECHNICAL FIELD

The present disclosure is directed generally to inventive methods and apparatus for encoding information on an AC line voltage. More particularly, various inventive methods and apparatus disclosed herein relate to controlling lighting devices via an encoded AC power signal.

BACKGROUND

In various lighting applications it is often desirable to adjust the intensity of light generated by one or more light sources. This is typically accomplished via a user-operated device, commonly referred to as a "dimmer," that adjusts the power delivered to the light source(s). Many types of conventional dimmers are known that allow a user to adjust the light output of one or more light sources via some type of user interface (e.g., by turning a knob, moving a slider, etc., often mounted on a wall in proximity to an area in which it is desirable to adjust the light level). The user interface of some dimmers also may be equipped with a switching/adjustment mechanism that allows one or more light sources to be switched off and on instantaneously, and also have their light output gradually varied when switched on.

Many lighting systems for general interior or exterior illumination often are powered by an alternating current ("AC") source, commonly referred to as a "line voltage" (e.g., 120 Volts RMS at 60 Hz, 220 Volts RMS at 50 Hz). An AC dimmer typically receives the AC line voltage as an input, and some conventional dimmers provide an AC signal output having one or more variable parameters that have the effect of adjusting the average voltage of the output signal (and hence the capability of the AC output signal to deliver power) in response to user operation of the dimmer. This dimmer output signal generally is applied, for example, to one or more light sources that are mounted in conventional sockets or fixtures coupled to the dimmer output (such sockets or fixtures sometimes are referred to as being on a "dimmer circuit").

Conventional AC dimmers may be configured to control power delivered to one or more light sources in a number of different ways. For example, the adjustment of the user interface may cause the dimmer to increase or decrease voltage amplitude of the AC dimmer output signal. In other configurations, the adjustment of the user interface may cause the dimmer to adjust the duty cycle of the AC dimmer output signal (e.g., by "chopping-out" portions of AC voltage cycles). This technique is sometimes referred to as "phase modulation" (based on the adjustable phase angle of the output signal). Perhaps the most commonly used dimmers of this type employ a TRIAC device that is selectively operated to adjust the duty cycle (i.e., modulate the phase angle) of the dimmer output signal by chopping-off rising portions of AC voltage half-cycles (i.e., after zero-crossings and before peaks). Other types of dimmers that adjust duty cycles may employ gate turn-off (GTO) thyristors or insulated-gate bipolar transistors (IGBTs) that are selectively operated to chop-off falling portions of AC voltage half-cycles (i.e., after peaks and before zero-crossings).

FIG. 1 generally illustrates some conventional AC dimmer implementations. In particular, FIG. 1 shows an example of an AC voltage waveform 302 (e.g., representing a standard line voltage) that may provide power to one or more conventional light sources. FIG. 1 also shows a generalized AC dimmer 304 responsive to a user interface 305. In the first implementation discussed above, the dimmer 304 is configured to output the waveform 308, in which the amplitude 307 of the dimmer output signal may be adjusted via the user interface 305. In the second implementation discussed above, the dimmer 304 is configured to output the waveform 309, in which the duty cycle 306 of the waveform 309 may be adjusted via the user interface 305.

Both of the foregoing techniques have the effect of adjusting the average power applied to the light source(s), which in turn adjusts the intensity of light generated by the source(s). Incandescent sources are particularly well-suited for this type of operation, as they produce light when there is current flowing through a filament in either direction; as the RMS voltage of an AC signal applied to the source(s) is adjusted (e.g., either by an adjustment of voltage amplitude or duty cycle), the power delivered to the light source also is changed and the corresponding light output changes. With respect to the duty cycle technique, the filament of an incandescent source has thermal inertia and does not stop emitting light completely during short periods of voltage interruption. Accordingly, the generated light as perceived by the human eye does not appear to flicker when the voltage is "chopped," but rather appears to gradually change.

Other types of conventional dimmers provide a 0-10 volt analog signal as output, wherein the voltage of the output signal is proportional to the desired dimming level. In operation, such dimmers typically provide for 0% dimming (i.e., light output "full on") when the dimmer output voltage is 10 volts, and 100% dimming (i.e., light output "off") when the dimmer output voltage is 0 volts. In one aspect, these dimmers may be configured to provide different linear or non-linear output voltage curves (i.e., relationship between output voltage and dimming ratio).

Still other types of conventional dimmers, such as those that employ a DMX512 control protocol in which packets of data may be transmitted to one or more lighting units via one or more data cables (e.g., a DMX512 cable). DMX512 data is sent using RS-485 voltage levels and "daisy-chain" cabling practices. In a typical DMX512 protocol, data is transmitted serially at 250 kbit/s and is grouped into packets of up to 513 bytes, called "frames". The first byte is always the "Start code" byte, which tells the connected lighting units which type of data is being sent. For example, for conventional dimmers, a start code of zero is typically used.

Yet other types of conventional dimmers output various types of digital signals corresponding to the desired dimming level. For example, some conventional dimmers may implement either the digital signal interface (DSI) protocol or the digital addressable lighting interface (DALI) protocol. When configured as a DALI controller, a dimmer may address and set the dimming status of each lighting unit in the DALI network. This may be accomplished by individually addressing lighting units in the network or by broadcasting a digital message to multiple lighting units to adjust their lighting properties.

Digital lighting technologies, i.e., illumination based on semiconductor light sources, such as light-emitting diodes ("LEDs"), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g., red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference. Also, some methods for providing power to devices via an A.C. power source, and for facilitating the use of LED-based lighting sources on A.C. power circuits that provide signals other than standard line voltages are disclosed in U.S. Pat. No. 7,038,399, also incorporated herein by reference.

Thus, there is a need in the art to enable efficient encoding of information relating to one or more parameters of the light generated by, for example, LED-based lighting units(s), on the AC line voltage, thereby providing an encoded power signal for controlling and powering the lighting units(s).

SUMMARY

The present disclosure is directed to inventive methods and apparatus for encoding an AC line voltage with information. For example, an AC line voltage may be encoded with control information, such as dimming information derived from an output signal of a conventional dimmer, so as to provide an encoded AC power signal. In various embodiments, one or more lighting units, including LED-based lighting units, may be both provided with operating power and controlled (e.g., dimmed) based on the encoded power signal. In one implementation, information may be encoded on the AC line voltage by inverting some half cycles of the AC line voltage to generate an encoded AC power signal, with the ratio of positive half-cycles to negative half-cycles representing the encoded information. The encoded information may relate to one or more parameters of the light generated by the LED-based lighting unit(s) (e.g., intensity, color, color temperature, etc.).

One embodiment of the invention is directed to a method, comprising deriving dimming information from an output signal of a dimmer, encoding an AC line voltage with the dimming information so as to generate an encoded AC power signal having a substantially similar RMS value as the AC line voltage, and controlling and providing operating power to at least one light source based at least in part on the encoded AC power signal.

Another embodiment is directed to an apparatus, comprising a first input for receiving an AC line voltage, a second input for receiving an output signal of a dimmer, an output for generating an encoded AC power signal, and a controller, coupled to the first input, the second input, and the output, for deriving dimming information from the output signal of the dimmer and encoding the AC line voltage with the dimming information so as to generate the encoded AC power signal.

Another embodiment is directed to a method of encoding information on an AC line voltage. The method comprises controlling a plurality of switches connected to the AC line voltage to invert at least some half cycles of the AC line voltage so as to generate an encoded AC power signal, wherein a ratio of positive half-cycles to negative half-cycles of the encoded AC power signal represents the information.

Another embodiment is directed to an apparatus, comprising a plurality of switches coupled to an AC line voltage and a controller for receiving information and controlling the plurality of switches based on the received information to invert at least some half cycles of the AC line voltage so as to generate an encoded AC power signal, wherein a ratio of positive half-cycles to negative half-cycles of the encoded signal represents the received information.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

LED-based light sources have gained in popularity due to their relatively high efficiency, high intensity, low cost, and high level of controllability compared to conventional incandescent or fluorescent light sources. While various types of conventional AC dimmers often are employed to control conventional light sources, such as incandescent lights using an AC power source, in some instances conventional dimmers may also be employed to control particularly configured LED-based lighting units, as discussed for example in U.S. Pat. No. 7,038,399.

As discussed above in connection with FIG. 1, inexpensive commonly available dimmers do not necessarily provide an AC power signal having the same or substantially the same RMS value as the available AC line voltage. Applicants have recognized and appreciated that in some circumstances this may make it challenging to provide both operating power and dimming information to multiple LED-based lighting units/fixtures coupled to the same dimming circuit. Applicants have also recognized and appreciated that due to the significant variety of inexpensive conventional dimmers readily available on the market, it would be beneficial to have an interface that would facilitate compatibility between various types of dimmers and one or more lighting units configured to receive operating power from an AC line voltage.

More generally, Applicants have recognized and appreciated that it would be beneficial to encode various types of information on an AC line voltage to generate an encoded AC power signal that may be employed to provide both full operating power and control information to various electrical apparatus.

In view of the foregoing, some embodiments of the present invention are directed to methods and apparatus for encoding an AC line voltage with dimming information derived from an output signal of a conventional dimmer so as to generate an AC power signal encoded with the dimming information, wherein the encoded AC power signal has a substantially similar RMS value as the AC line voltage.

Figure 2:
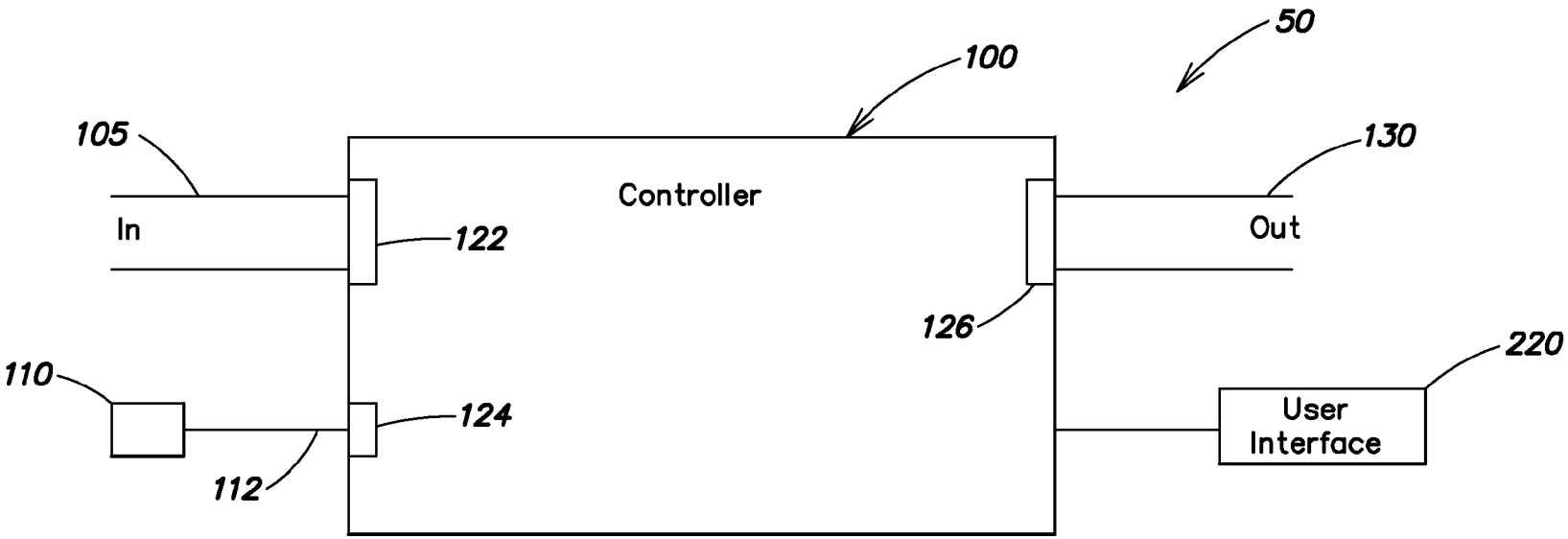
FIG. 2 illustrates an information encoding apparatus according to one embodiment of the invention.

FIG. 2 illustrates an information encoding apparatus 50 according to one embodiment of the present invention. The apparatus comprises a controller 100, a first input 122 for receiving an AC line voltage 105 and a second input 124 for receiving an output signal 112 generated from an information source 110. In one aspect, the AC line voltage 105 may be provided by coupling the first input 122 to a standard wall socket (e.g., the first input 122 may be implemented as a standard wall plug). The apparatus 50 further comprises an output 126 to provide an encoded AC output power signal 130. In one aspect, the encoded AC power signal 130 may have a substantially similar RMS value as the AC line voltage 105.

Figure 1:
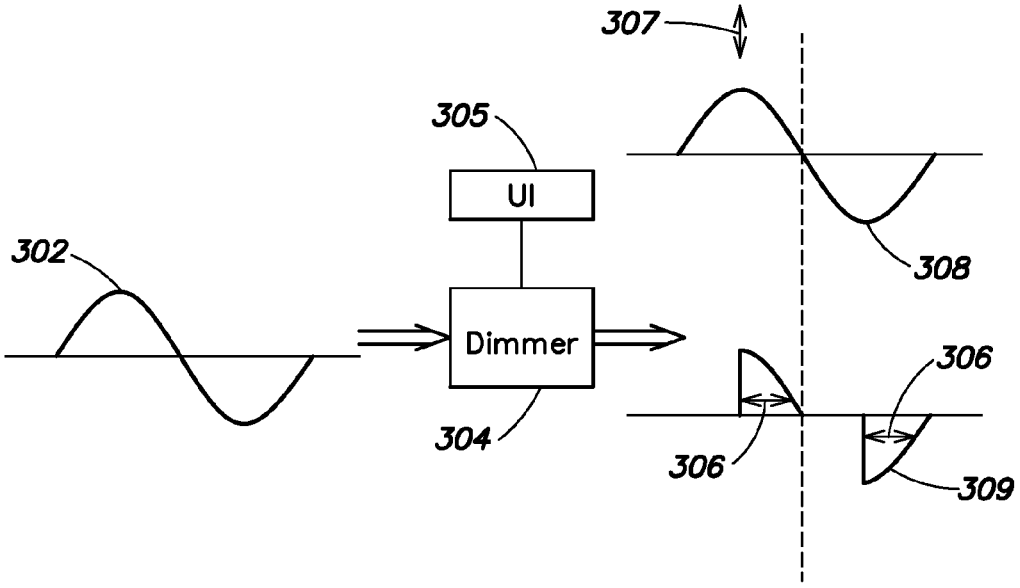
FIG. 1 (Prior Art)
FIG. 1 illustrates exemplary operation of conventional AC dimming devices.

In some embodiments, the information source 110 may be a conventional dimmer such as those described above (e.g., in connection with FIG. 1). Accordingly, it should be appreciated that in various embodiments, examples of possible output signals 112 include, but are not limited to, an amplitude modulated AC signal, a duty cycle (phase angle) modulated AC signal, a 0-10 volt DC analog signal, packets of control data according to a DMX512 protocol, or a digital signal such as a DSI or DALI signal to provide dimming information to the controller 100. More generally, it should be appreciated that an information source 110 according to other embodiments may provide various types of information other than dimming information to the controller 100 via the output signal 112 (e.g., light color or color temperature information), or information including a combination of dimming information and other information.

According to some embodiments of the present invention, the controller 100 may be configured to interface with a single type of output signal 112. In other embodiments of the present invention, the controller 100 may be configured to interface with any one or more of the same or different information sources 110 that may provide various types/formats of output signals 112, such as those mentioned above or others. In one embodiment, multiple different information sources may provide respective substantially different output signals, and the controller 100 may be configured to select between any one of several possible output signals at any given time to facilitate encoding of a particular type of information and/or a particular type/format of output signal. For example, the controller 100 may be connected to a first dimmer that outputs a duty-cycle modulated AC signal and/or a second dimmer that outputs a digital signal based on the DALI protocol. In one exemplary implementation, as shown in FIG. 2, selection between multiple information sources/output signals may be made via an optional user-interface 220 connected to the controller 100.

Figure 3:
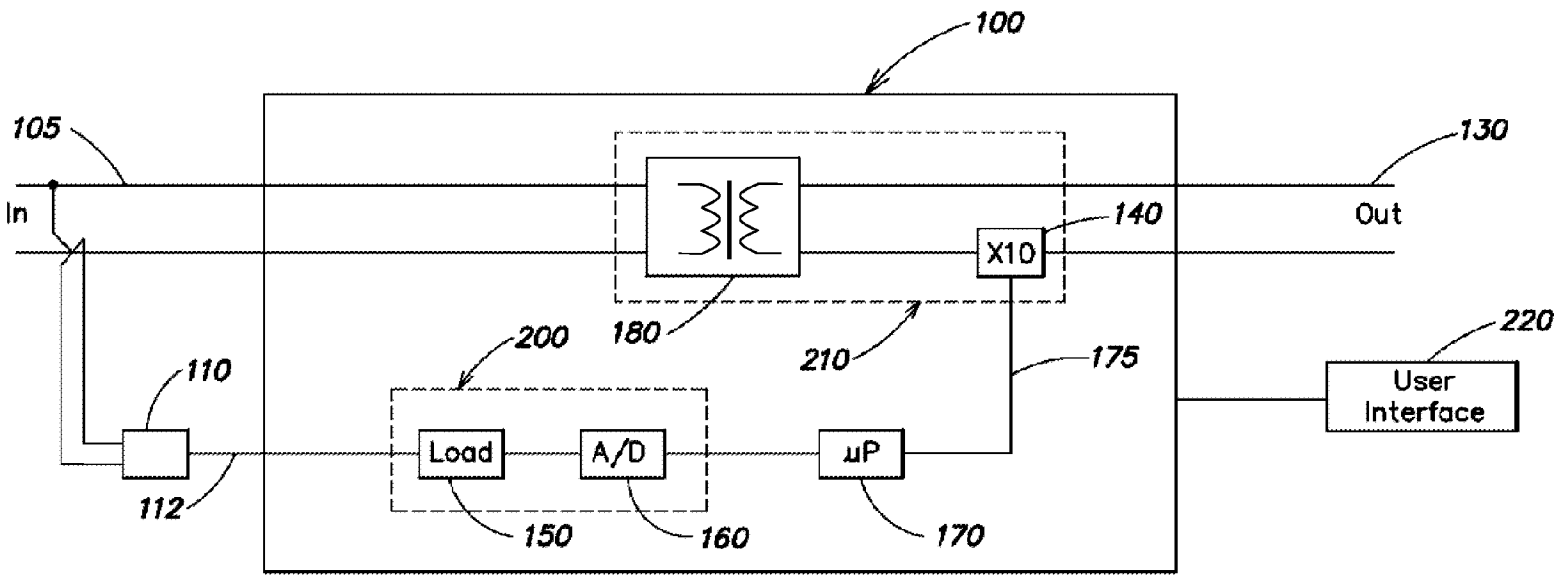
FIG. 3 is a block diagram showing various elements of the information encoding apparatus of FIG. 2 according to one embodiment of the invention.

According to one embodiment, the controller 100 may comprise various components designed to facilitate the encoding of dimming and/or other information provided by the output signal 112 onto the AC line voltage 105, as shown in FIG. 3. For example, the controller 100 may comprise a sampling circuit 200 for sampling the output signal 112, and an encoding circuit 210 for isolating the input AC line voltage 105 from the output encoded AC power signal 130, and for encoding the dimming and/or other information on the AC power signal.

In one implementation, the sampling circuit 200 may comprise a dummy load 150. In general, the dummy load 150 may be a power resistor, or any other suitable resistive device including, but not limited to, passive resistive devices and active resistive devices. In one implementation, the dummy load 150 may have a fixed resistive value and may be chosen such that the power consumed by the load 150 is less than, for example, 8 watts. In other implementations, the resistance value of the dummy load 150 may be adjusted to reduce the amount of power consumed by the load 150, while still maintaining the proper functioning of the information source 110. For example, some conventional dimmers require that a load having at least a minimum resistance value be coupled to the dimmer output to produce an output signal that accurately reflects the dimming information provided by the dimmer. In such implementations, the adjustable resistance value may be user-configurable by adjusting a knob, switch, or any other suitable user-interface (e.g., user interface 220) provided on the controller 100. One example of a suitable dummy load 150 includes, but is not limited to, a LUT-LBX Synthetic Minimum Load device available from Lutron Electronics Company, Inc. of Coopersburg, Pa.

In some embodiments of the invention, the controller 100 may additionally comprise a microprocessor 170 coupled to the sampling circuit 200, which provides a processed information signal 175 to the encoding circuit 210. In one implementation, the microprocessor 170 may be implemented as part of an integrated circuit, wherein the integrated circuit also comprises other components that support the microprocessor, such as at least one memory device to store one or more computer programs that when executed on the microprocessor 170, control the functioning of various components of the controller 100. In another implementation, shown in FIG. 4, the sampling circuit 200 may comprise an integrated circuit with the microprocessor 170 having a universal asynchronous receiver/transmitter (UART) 510 and a processing module 520 for providing the processed information signal 175 to the encoding circuit 210.

Figure 5:
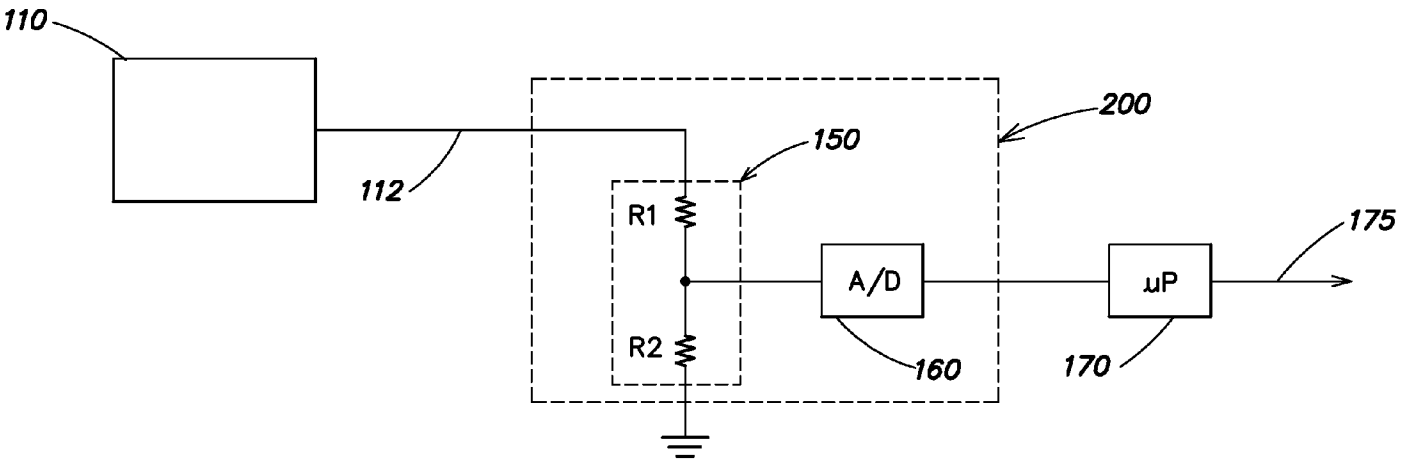
FIG. 5 illustrates a portion of the information encoding apparatus of FIG. 3 showing details of a sampling circuit according to another embodiment of the invention.

For implementations in which the output signal 112 is an analog signal, the sampling circuit may additionally comprise an A/D converter 160 for sampling the output signal (e.g., a voltage across the dummy load 150). For example, as shown in FIG. 5, the dummy load 150 may be a voltage divider circuit to which the output signal 112 is applied. The voltage divider circuit may comprise at least two resistive components arranged in series, and the A/D converter 160 may be arranged to sample the voltage across either one or both of the resistive components. In one embodiment, the microprocessor 170 and associated storage components (not shown) may calculate a time-average of the sampled voltage to provide as input to the encoding circuit 210, wherein the time-average voltage represents the information to be encoded on the AC line voltage 105. In an alternative implementation, the voltage waveform of the output signal 112 itself may be directly sampled by A/D converter 160 (e.g., without an intervening dummy load) and processed by microprocessor 170 and associated storage components. An analysis of the voltage waveform by microprocessor 170 may reveal changes in characteristics of the voltage waveform. In this alternative implementation, one or more aspects of the detected changes in characteristics may represent the information to be encoded and may be provided by the microprocessor 170 to the encoding circuit 210. It should be appreciated that any other suitable combination of resistive elements and measurement by the A/D converter 160 may be employed, and embodiments of the invention are not limited in these respects.

In yet another implementation, the A/D converter 160 may not sample (directly or indirectly) the output signal 112 as described above, but may instead comprise a threshold detection circuit. The threshold detection circuit may comprise a comparator circuit and/or other circuit elements to facilitate threshold detection of output signal 112. For example, the output signal 112 may be provided as a first input to a comparator circuit which outputs a particular logic state (e.g., a binary value of 1) when the absolute value of the output signal 112 voltage is greater than a threshold voltage (e.g., 2 volts) provided as a second input to the comparator circuit. A desired threshold voltage for the threshold detection circuit may be determined based on the known peak-to-peak voltage of the AC line voltage 105. Since the frequency of the AC line voltage is also known, timing information based on the generation of the digital signal output from the threshold detection circuit may be provided as the processed information signal 175 to the encoding circuit 210. For example, the timing information may be derived by sampling the digital output of the threshold detection circuit. Alternatively, the output of the threshold detection circuit may be used as a controlling input to a timer on a microcontroller, the microcontroller providing the processed information signal 175 to the encoding circuit 210. It should be appreciated that any suitable combination of circuit elements may be employed for threshold detection of output signal 112 and for the generation of the timing information, and embodiments of the invention are not limited in these respects.

Figure 4:
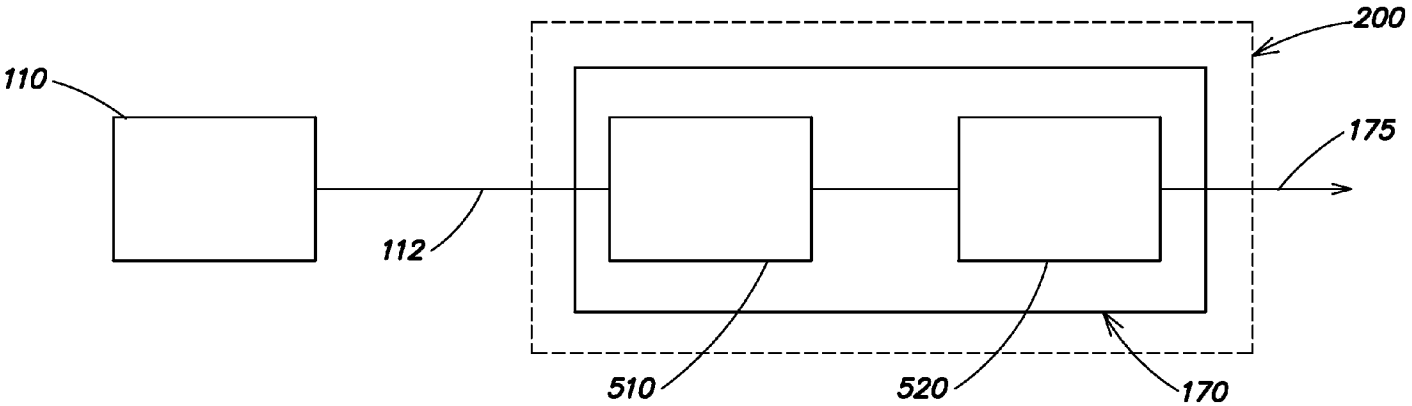
FIG. 4 illustrates a portion of the information encoding apparatus of FIG. 3 showing details of a sampling circuit according to one embodiment of the invention.

According to other embodiments in which the output signal 112 is a digital signal (e.g., a DSI or DALI signal), with reference to FIG. 4, UART 510 may sample the digital output signal 112 and provide the sampled digital output signal to the processing module 520. The processing module may then process the sampled digital output signal to produce the information signal 175. The mapping between the sampled digital output signal and the information signal 175 may be linear or non-linear, and embodiments of the invention are not limited in this respect.

In one embodiment of the present invention, the microprocessor 170 may be configured to execute one or more computer programs. The one or more computer programs may comprise a series of instructions that when executed on microprocessor 170 process the sampled output from A/D converter 160 or the sampled output signal 112 itself to provide the information signal 175, which in turn may be encoded by encoding circuit 210. The relationship between the signal input to the microprocessor 170 and the information signal 175 output by the microprocessor 170 may be linear or non-linear, and embodiments of the invention are not limited in this respect. For example, one typical characteristic of conventional incandescent dimming is that light generated from an incandescent source becomes warmer in color temperature (i.e., redder) as the light source is dimmed. In one implementation, the relationship between the signal input to the microprocessor 170 and the information signal 175 may be particularly configured so as to mimic this effect in an LED-based lighting unit by providing by both intensity and color/color temperature information in the information signal 175 based on dimming information provided by the output signal 112. In other examples, non-linear relationships between sampled parameters of the output signal 112 and the information signal 175 may be used to achieve a variety of custom lighting conditions/effects.

In another embodiment, the microprocessor 170 may be configured to execute one or more computer programs to perform a calibration method to account for at least some of the inaccuracy of conventional dimmers when set to the "full on" or "full off" positions. For example, if the information source 110 is a conventional dimmer, and the output signal 112 is a 0-10 volt DC analog signal, manufacturing variations from dimmer to dimmer may cause a given dimmer to not provide exactly 0 volts when set to "full off" or exactly 10 volts when set to "full on". By calibrating the output signal 112, the dynamic range of actual dimming that is effected via the encoded AC output power signal 130 may be expanded, and the low-end and/or high-end accuracy of the dimmer may be increased.

In yet another embodiment, the microprocessor 170 may be configured to execute one or more computer programs that facilitate interpolation (i.e., smoothing) between sampled dimming levels, and particularly when the dimming information derived from the output signal 112 indicates one or more large jumps in dimming level. For example, the information signal 175 may be based at least in part on previous dimming information provided to the microprocessor 170 so as to provide a smooth transition between dimming levels that are prescribed by the encoded AC power signal 130. In other embodiments, smoothing between dimming levels may be provided by the incorporation of one or more additional circuit elements, such as a capacitor coupled to the dummy load 150.

In one embodiment of the present invention as shown in FIG. 3, the encoding circuit 210 may comprise an isolation circuit 180 for isolation of the input AC line voltage 105 from the output encoded AC power signal 130, and an encoding device 140 for receiving the information signal 175 from the microprocessor 170 and encoding information on the line voltage 105 to provide the encoded power signal 130. In one embodiment of the invention, the isolation circuit 180 comprises a transformer to provide electromagnetic isolation between the input line voltage 105 and the output encoded AC power signal 130. However, it should be appreciated that while the isolation circuit 180 described above comprises electromagnetic isolation means, various embodiments of the invention may comprise any suitable isolation means including, but not limited to, optical and/or capacitive isolation means, and the invention is not limited in this respect.

Information may be encoded on the line voltage using any suitable protocol. In some embodiments of the invention, the information encoding may be implemented using a power line carrier (PLC)-based protocol. PLC protocols often are used for controlling devices in a home, and operate by modulating information in a carrier wave of between 20 and 200 kHz in to the existing electrical wiring in the home (i.e., wiring that supplies a standard AC line voltage). One example of such a control protocol is given by the X10 communications language. In a typical X10 implementation, an appliance to be controlled (e.g., lights, thermostats, jacuzzi/hot tub, etc.) is plugged into an X10 receiver, which in turn plugs into a conventional wall socket coupled to the AC line voltage. The appliance to be controlled is assigned a particular address. An X10 transmitter/controller is plugged into another wall socket coupled to the line voltage, and communicates control commands (e.g., appliance on or off), via the same wiring providing the line voltage, to one or more X10 receivers based at least in part on the assigned address(es).

In a conventional X10 protocol, addressing and control command information is encoded as digital data onto a 120 Hz carrier which is transmitted as bursts during (or near) the zero crossings of the AC line voltage, with one bit being transmitted at each zero crossing. To control an operation of a X10-compatible device, an X10 transmitter/controller transmits addressing information to the device, and then in subsequent transmissions, sends control command information defining what command is to be performed by the device. In one example, a user may wish to turn on a X10-compatible lighting unit that has been given the address A25. To turn the lighting unit on, an X10 controller would transmit a message, such as "select A25" followed by a message "turn on." Since data is only transmitted at zero-crossings, data transmission rates using the X10 protocol are on the order of 20 bits/second. Accordingly, transmission of a device address and a command may take roughly 0.75 seconds.

In addition, the relatively high carrier frequency used in X10 communications cannot be transmitted effectively across power transformers (e.g., in isolation circuit 180), so that together with the isolation circuit 180, X10 encoding allows for effective isolation of the AC line voltage 105 from the encoded AC power signal 130. Thus, according to one embodiment, methods and apparatus of the present invention facilitate compatibility of various LED-based light sources and lighting units with X10 and other PLC communication protocols that communicate control information in connection with an AC line voltage.

It should be appreciated that the specific example of X10 as an example of a PLC-based protocol for encoding information on an AC line voltage is provided primarily to illustrate one type of PLC encoding protocol, and embodiments of the invention are not limited in this respect. For example, other PLC control protocols including, but not limited to, KNX, INSTEON, BACnet, and LonWorks, or any other suitable protocol for encoding information on an AC line voltage, may be used.

Figure 6:
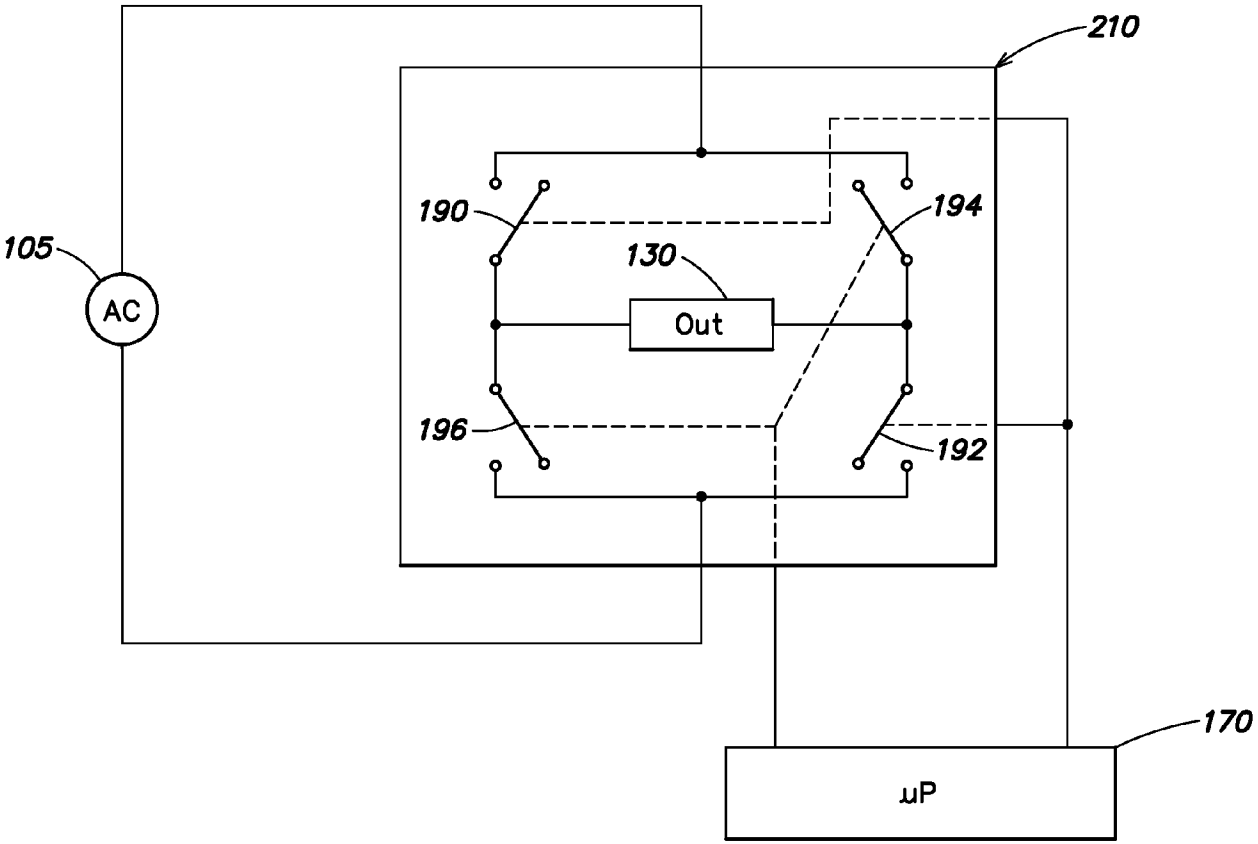
FIG. 6 is a schematic of an encoding circuit according to one embodiment of the invention.

An alternative implementation of the encoding circuit 210 according to one embodiment of the invention is shown in FIG. 6. In this embodiment, both the isolation between the input line voltage and the encoded AC output power signal, as well as the encoding of information, is accomplished by using a plurality of switches 190, 192, 194, and 196, whose operation is controlled by microprocessor 170. According to one embodiment of the invention, the switches form an H-bridge (otherwise known as a "full bridge") circuit as shown in FIG. 6. The two lines of the conventional input AC line voltage 105 supply current to the top and bottom branches of the H-bridge circuit, and the encoded AC output power signal 130 is dependent on the state of the switches 190, 192, 194, and 196.

Figure 7:
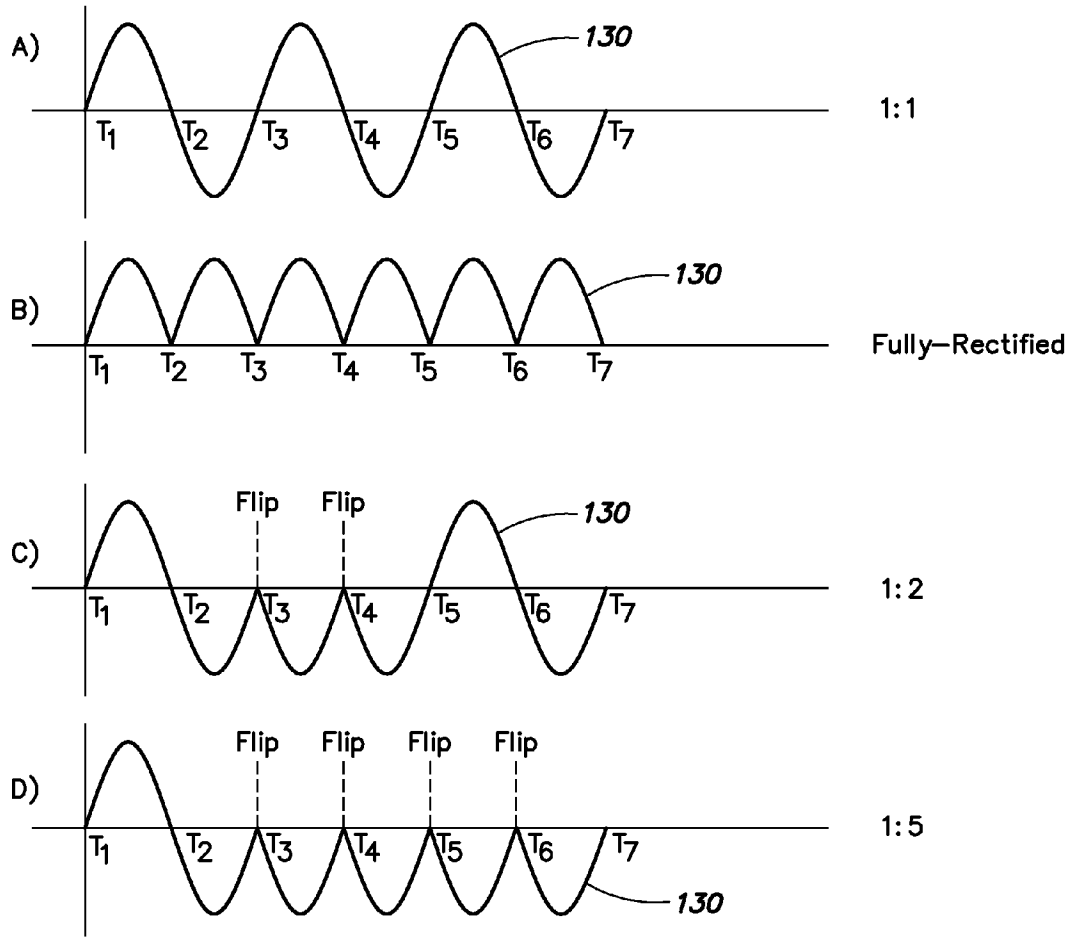
FIGS. 7A, 7B, 7C, and 7D illustrate exemplary signals generated by the encoding circuit of FIG. 6, according to various embodiments of the invention.

To produce the encoded AC output power signal 130 output of the H-bridge circuit using an input AC line voltage 105, the switches are controlled in alternating pairs. Which pair of switches is closed at any one time, and the phase of the input AC line voltage 105, determines the polarity of the encoded AC output power signal 130. For example, to reproduce the sinusoidal encoded AC output power signal as shown in FIG. 7A (i.e., identical to the AC line voltage 105), either switch pair 190-192 or switch pair 194-196 would be closed, while the other switch pair would be open. Alternatively, if the switch pairs 190-192 and 194-196 are alternately switched during each zero-crossing of input AC line voltage waveform (i.e., every half-cycle), the H-bridge circuit would essentially operate as a full-wave rectifier to produce the waveform shown in FIG. 7B.

In one embodiment of the invention, the microprocessor 170 controls the switch timing of the switch pairs 190-192 and 194-196 based at least in part on the information derived from the output signal 112. Suppose that the waveform shown in FIG. 7C is the desired encoded AC output power signal 130. At a time $T_3$, the microprocessor 170 may "flip" a half-cycle of input line voltage 105. To accomplish this, the microprocessor 170 may send control commands to the H-bridge circuit at a time $T_3$ to switch the pairs that are closed (e.g., switch from 190-192 to 194-196), and then at a time $T_4$ send control commands to switch the pairs again (i.e., switch from 194-196 to 190-192). Similarly, to provide an encoded AC power signal 130 corresponding to the waveform shown in FIG. 7D, the microprocessor 170 may send control commands to the H-bridge circuit at times $T_3$ $T_4$, $T_5$, and $T_6$ to switch the pairs that are closed.

In one embodiment of the invention, information may be encoded on the AC line voltage as being proportional to the ratio of positive half-cycles to negative half-cycles of the output AC power signal 130 over some time period. For example, the encoded AC power signal shown in FIG. 7A has a positive half-cycle to negative half-cycle ratio of 1:1. In some embodiments where the encoded information is dimming information, this ratio may indicate a dimming level of 100%. In contrast, the encoded AC power signal shown in FIG. 7C has a ratio of 1:2, and as such, may correspond to a dimming level of 50%. In a similar manner, the encoded AC power signal shown in FIG. 7D has a ratio of 1:5, and this may correspond to a dimming level of 20%.

The example waveforms shown in FIGS. 7A-7D show only three cycles of the encoded AC power signal 130 over which the ratio of positive half-cycles to negative half-cycles is determined. It should be appreciated that any number of cycles over which the encoding may be performed is possible, and the more cycles over which the encoding is performed allows for higher resolution of the encoded information (e.g., more dimming levels to be specified). However, choosing a larger number of cycles over which the encoding is performed also results in lower rates of encoding. In some exemplary embodiments of the invention, it is desirable to balance a relatively low-rate of encoding with having a sufficient number of dimming levels to provide useful dimming for practical applications. Therefore, in some exemplary embodiments, encoding may be performed over a range between 5-10 cycles, to correspondingly provide for 5-10 different dimming levels.

It should be appreciated that in various embodiments of the invention, the switches in the H-bridge circuit shown in FIG. 6 may be implemented as any suitable type of switch including, but not limited to, bipolar junction transistors (BJTs), metal-oxide field effect transistors (MOSFETs), IGBTs, and silicon-controlled rectifiers (SCRs).

Figure 8:
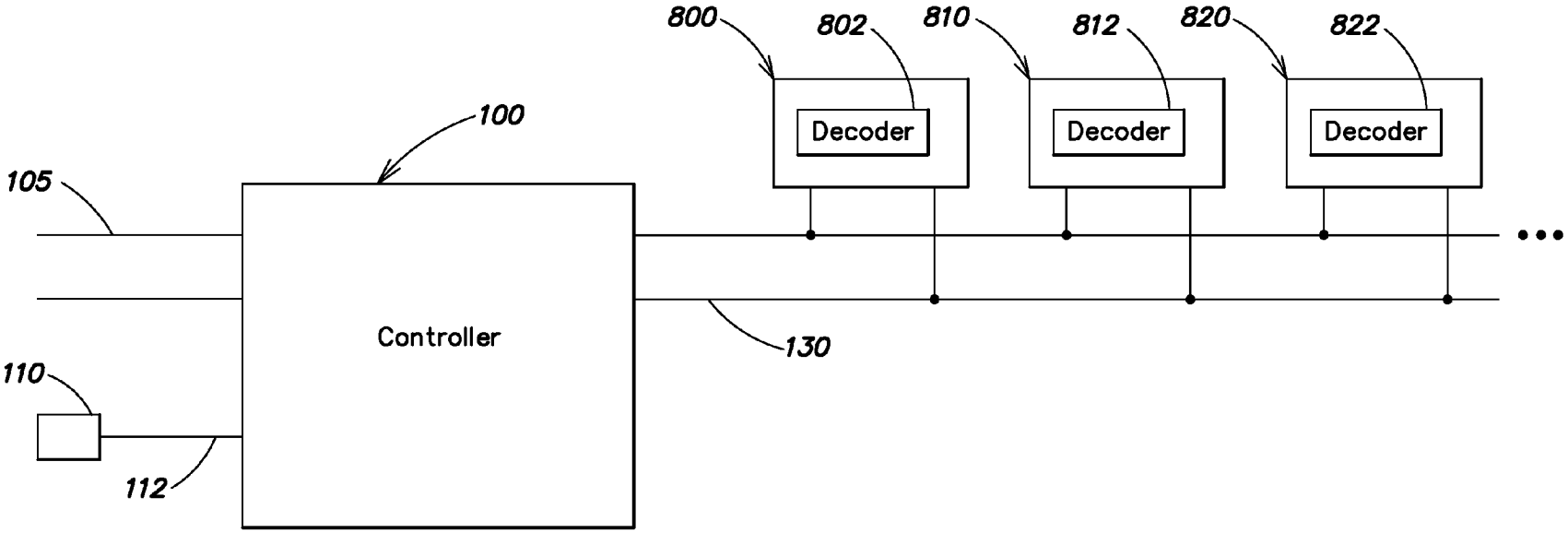
FIG. 8 illustrates a lighting system for use with various embodiments of the invention.

FIG. 8 illustrates that, according to some embodiments of the invention, one or more LED-based lighting units/fixtures 800, 810, 820 may be connected to the controller 100 to receive both operating power and the information provided by the encoded AC output signal 130 so as to adjust the light generation properties the one or more lighting units/fixtures. In order to effectively modulate its light generation properties, each lighting unit may comprise at least one decoder (e.g., decoders 802, 812, and 822) to decode the encoded AC output power signal 130. The decoding may be accomplished in any one of several ways depending ton the encoding method/protocol used to encode the power signal 130, and embodiments of the invention are not limited in this respect.

In some embodiments, as discussed above, the information may be encoded on the AC line voltage using a PLC protocol, such as the X10 protocol. Decoders 802, 812, 822 associated with each lighting unit 800, 810, and 820 may be configured as X10 receivers to decode the X10 information from the encoded AC output power signal 130, and to provide the information to the lighting unit to alter its light generation properties as desired.

In other embodiments, information may be encoded on the AC line voltage as a ratio of positive to negative half-cycles, as described above in connection with FIGS. 6 and 7, and the lighting unit(s) may decode the information on the encoded AC output power signal 130 by calculating the ratio of positive to negative half-cycles during a predetermined time interval. In one embodiment, decoders (e.g., decoders 802, 812, 822) may monitor zero-crossings in the encoded AC output power signal 130 to determine the polarity of the signal either immediately proceeding and/or following each zero-crossing. By integrating over a predetermined number of cycles, the lighting unit(s) may determine a desired level of dimming (i.e., if the information is dimming information). In an alternative embodiment, the decoders may determine a ratio of positive to negative half-cycles by sampling the encoded AC output power signal 130 at a faster sampling rate than the frequency of the signal (e.g., faster than 60 Hz) and detect changes in one or more characteristics of the AC signal. For example, a typical sampling rate may be 120 Hz.

In fact, the encoding and decoding can be performed in any manner, as long as both the encoding circuit 210 and the lighting unit(s) coupled to the power signal 130 are both aware of a common protocol for determining over how may half-cycles the ratio should be calculated to provide the appropriate drive signal to the LED(s). It should appreciated that any other suitable method for determining a ratio of positive to negative half-cycles in the encoded AC output power signal may be used, and the aforementioned specific examples are provided for illustrative purposes only, and are not limiting.

In yet other embodiments, multiple light generation properties of one or more LED-based lighting units may be altered in response to receiving information encoded on an AC line voltage. For example, in one embodiment, one or more LED-based lighting units coupled to controller 100 may be configured to essentially recreate the lighting characteristics of a conventional incandescent light as the lighting unit(s) is/are provided with dimming information via the encoded AC output power signal 130. In one aspect of this embodiment, this may be accomplished by simultaneously varying the intensity and the color/color temperature of the light generated by the LED-based lighting units.

More specifically, in conventional incandescent sources, the color temperature of light emitted generally reduces as the power dissipated by the light source is reduced (e.g., at lower intensity levels, the correlated color temperature of the light produced may be near 2000K, while the correlated color temperature of the light at higher intensities may be near 3200K). This is why an incandescent light tends to appear redder as the power to the light source is reduced. Accordingly, in one embodiment, an LED-based lighting unit may be configured such that a single dimmer adjustment may be used to simultaneously change both the intensity and color of the light source so as to produce a relatively high correlated color temperature at higher intensities (e.g., when the dimmer provides essentially "full" power) and produce lower correlated temperatures at lower intensities, so as to mimic an incandescent source.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A method, comprising:

receiving an AC line voltage;

receiving a dimmed AC line voltage having an amplitude and a duty cycle, wherein one of the amplitude and the duty cycle are adjusted with respect to the AC line voltage;

extracting dimming information from the received dimmed AC line voltage;

encoding the received AC line voltage with the extracted dimming information so as to generate an encoded AC power signal having a substantially similar RMS value as the AC line voltage; and controlling and providing operating power to at least one LED-based lighting unit based at least in part on the encoded AC power signal.

2. The method of claim 1, wherein controlling and providing operating power to at least one LED-based lighting unit comprises changing at least one of an intensity, color, and/or color temperature of light generated by the at least one LED-based lighting unit.

3. The method of claim 1, wherein extracting the dimming information from the received dimmed AC line voltage comprises digitally sampling the received dimmed AC line voltage to obtain the dimming information.

4. The method of claim 3, wherein extracting the dimming information from the received dimmed AC line voltage comprises calculating a time-average voltage potential of the output signal of the dimmer.

5. The method of claim 3, wherein extracting the dimming information from the received dimmed AC line voltage comprises sampling the received dimmed AC line voltage using a resistor divider circuit.

6. The method of claim 1, wherein extracting the dimming information from the received dimmed AC line voltage comprises providing a dummy load connected to the received dimmed AC line voltage.

7. The method of claim 1, wherein encoding the received AC line voltage with the extracted dimming information comprises periodically frequency modulating the AC line voltage.

8. The method of claim 1, wherein encoding the received AC line voltage with the extracted dimming information comprises encoding the AC line voltage using an X10 protocol.

9. The method of claim 1, wherein encoding the received AC line voltage with the extracted dimming information comprises controlling a plurality of switches connected to the AC line voltage to invert at least some half cycles of the AC line voltage so as to generate the encoded AC power signal, wherein a ratio of positive half-cycles to negative half-cycles of the encoded AC power signal represents the extracted dimming information.

10. The method of claim 1, further comprising electrically isolating the AC line voltage from the encoded AC power signal via a transformer.

11. An apparatus, comprising:

a first input configured to receive an AC line voltage;

a second input configured to receive a dimmed AC line voltage having an amplitude and a duty cycle, wherein one of the amplitude and the duty cycle adjusted with respect to the AC line voltage;

a device configured to receive the dimmed AC line voltage from the second input and further configured to extract dimming information from the dimmed AC line voltage;

an encoder configured to receive the AC line voltage and the extracted dimming information and in response thereto to encode the AC line voltage with the extracted dimming information so as to generate an encoded AC power signal; and at least one light source controlled based at least in part on the encoded AC power signal.

12. The apparatus of claim 11, wherein the device configured to receive the dimmed AC line voltage form the second input and further configured to extract dimming information from the dimmed AC line voltage further includes a microprocessor configured to sample the dimmed AC line voltage to extract the dimming information.

13. The apparatus of claim 11, further comprising a conversion circuit configured to encode the AC line voltage with the extracted dimming information.

14. The apparatus of claim 11, wherein the device which is configured to extract the dimming information from the dimmed AC line voltage includes a dummy load to which the dimmed AC line voltage is connected.

15. The apparatus of claim 14, wherein the dummy load is a power resistor.

16. The device of claim 14, wherein the device which is configured to extract the dimming information from the dimmed AC line voltage further comprises an analog-to-digital converter connected to sample and digitize a voltage across at least a part of the dummy load.

17. The apparatus of claim 11, wherein the device which is configured to extract the dimming information from the dimmed AC line voltage comprises:

a sampler configured to digitally sample the dimmed AC line voltage; and a microprocessor configured to extract the dimming information from the sampled dimmed AC line voltage.

18. The apparatus of claim 11, further comprising an isolation transformer connected to isolate the AC line voltage from the encoded AC power signal.

19. A method of encoding information on an AC line voltage, the method comprising:

receiving the AC line voltage;

receiving a dimmed AC line voltage having an amplitude and a duty cycle wherein at least one of the amplitude and duty cycle are adjusted with respect to the AC line voltage;

extracting dimming information from the dimmed AC line voltage;

controlling a plurality of switches to invert at least some half cycles of the AC line voltage so as to generate an encoded AC power signal, wherein a ratio of positive half-cycles to negative half-cycles of the encoded AC power signal represents the extracted dimming information.

20. The method of claim 19, wherein controlling the plurality of switches comprises controlling the plurality of switches in pairs.

21. The method of claim 19, wherein the plurality of switches forms an H-bridge circuit.

22. The method of claim 19, wherein the plurality of switches includes at least one bipolar junction transistor and/or at least one MOSFET.

23. The method of claim 19, further comprising controlling the plurality of switches via a microprocessor coupled to the switches.

24. The method of claim 19, further comprising controlling at least one LED-based lighting unit based at least in part on the encoded AC power signal.

25. The method of claim 19, wherein extracting the dimming information comprises digitally sampling the dimmed AC line voltage to obtain the dimming information.

* * * * *